United States Patent [19]

Butts et al.

[11] 4,015,396

[45] Apr. 5, 1977

[54] JOIST

[75] Inventors: Ernest Otto Butts; Felix F. Laurus, both of Ottawa, Canada

[73] Assignee: Hambro Structural Systems Ltd., Ottawa, Canada

[22] Filed: June 3, 1975

[21] Appl. No.: 583,289

[30] Foreign Application Priority Data

June 11, 1974 Canada ..... 202200

[52] U.S. Cl. ..... 52/690; 52/729; 29/155 R

[51] Int. Cl.² ..... E04C 3/16; E04C 3/293; E04C 3/07

[58] Field of Search ..... 52/690, 692, 694, 695, 52/100, 334, 335; 29/155 R; 249/23

[56] References Cited

UNITED STATES PATENTS

| | | | |
|---|---|---|---|
| 1,629,479 | 5/1927 | Cober | 29/155 R |
| 1,725,501 | 8/1929 | Yeager | 52/690 |
| 1,911,018 | 5/1933 | Goeltz | 52/694 |
| 1,974,730 | 9/1934 | Zollinger | 52/321 |
| 2,256,812 | 9/1941 | Miller | 29/155 R |
| 2,459,037 | 1/1949 | McIntosh | 52/694 |
| 2,508,635 | 5/1950 | Badt | 249/23 |
| 3,284,971 | 11/1966 | Attwood | 52/100 |
| 3,845,594 | 11/1974 | Hall et al. | 52/690 |

FOREIGN PATENTS OR APPLICATIONS

| | | | |
|---|---|---|---|
| 1,162,523 | 4/1958 | France | 52/695 |
| 73,318 | 6/1960 | France | 52/695 |

OTHER PUBLICATIONS

F. R. Shanley, Strength of Materials, McGraw-Hill Book Co., N. Y., 1957, pp. 209–212.

*Primary Examiner*—James L. Ridgill, Jr.
*Attorney, Agent, or Firm*—Cushman, Darby & Cushman

[57] ABSTRACT

A steel joist having an upper chord, a web, and a lower chord; the upper chord consisting of an S shaped cross section elongated member having in one form a lower reverse flange at the base of the S, the flange being connected to the web so that the center of gravity of the joist is in the region of its central axis, the region between the base of the S and the reverse flange including an inclined step.

10 Claims, 4 Drawing Figures

JOIST

This invention is related to the field of composite steel and concrete structures and in particular floor structures. It is specifically related to the steel joists in such structures which are used during the forming of the structure and remain in place as reinforcing after the structure is formed.

The prior art structure as shown in applicant's Canadian Patents Nos. 847,180 issued June 29, 1971 and 885,156 issued Nov. 9, 1971; consists of joists which are unsymmetrical, such that when they are being placed in position with plywood sheets between them prior to pouring concrete, they tend to be unstable and easily tipped over.

This invention relates to a structure which is made almost symmetrical so avoiding the tendency to tip over during construction, and, as a further means to prevent tipping over, spacing bars are used to hold the joists in position and support them during construction. The top chord of the joist is also formed so that there is a specific place in which to insert the plywood sheets which supports the poured concrete during construction, this support for the plywood having an inclined step by which the plywood sheets positively force adjacent joists away from each other so that they are locked in position by the spacer bars. Further support bars are also utilized between and over the spacer bars, the main purpose of these support bars being to support and align the edges of adjacent plywood sheets.

This invention will now be described with reference to the accompanying drawings in which only preferred embodiments are shown:

Figure 1:
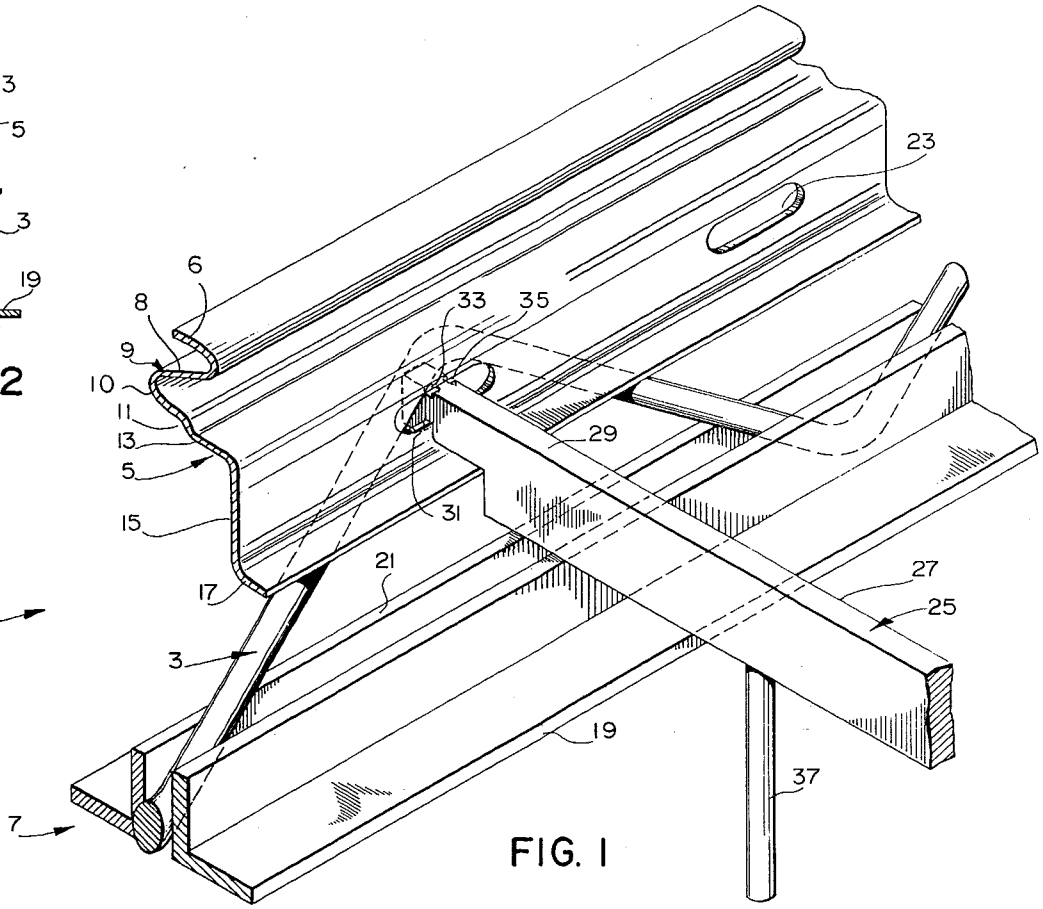
FIG. 1 is a perspective view of part of a composite joist and spacing bar arrangement according to an embodiment of this invention.
Figure 2:
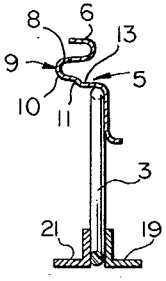
FIG. 2 is a reduced scale section of the joist of FIG. 1.

Referring to FIGS. 1 and 2, a fabricated metal joist 1 has an open web formed from rod 3, a top chord 5, and a bottom chord 7. The top chord has a zigzag cross section, such as an S-shaped upper section 9, having integral top, oblique and lower portions 6, 8 and 10 the latter of which has an underside that extends transversely substantially flat from the lower end of the oblique portion 10 for a substantial horizontal distance to its outer end at which it integrally connects to an inclined step 11 at the bottom of the S-shaped section, a flat plywood supporting shelf 13 from the step 11, a vertical partial web 15 which is welded to rod 3, and a small flange 17 at the lower end of the partial web 15. The lower chord consists of a pair of angles 19 and 21 which are welded respectively to both sides of the rod 3. The rod 3 is of zig-zag shape. Elongated apertures 23 are spaced at equal intervals along the partial web 15.

To correctly position the joists during construction, and to prevent them from tipping over, spacer bars such as the one shown are used. The spacer bar 25 consists of an elongated rectangular section body 27, reduced section ends 29, a notch 31 in the lower edge, and smaller notches 33 and 35 in the upper corners.

Handles, in the form of rods 37 (only one shown) are welded or otherwise suitably secured to the body 27.

Figure 3:
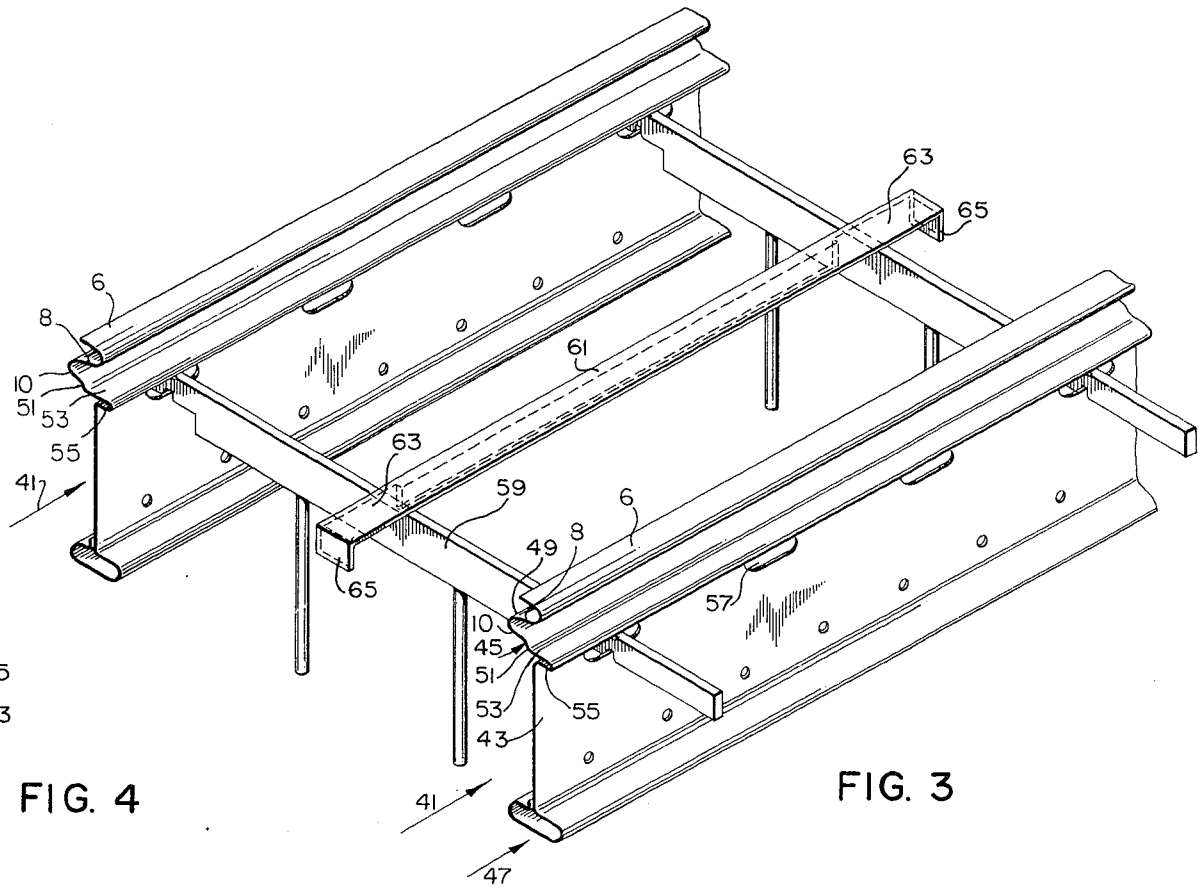
FIG. 3 is a perspective view of part of two sheet metal joists of this invention including spacing bars and a plywood support bar; and, FIG. 4 is a reduced scale section of one of the sheet metal joists of FIG. 3.
Figure 4:
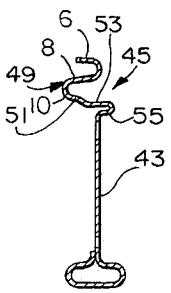

Referring to FIGS. 3 and 4, a pair of sheet metal joists 41 are shown, each joist consisting of a web 43, a top chord 45, and a bottom chord 47. The top chord has an S-shaped upper section 49, an inclined step 51 at the bottom of the S-shaped section, a flat plywood-supporting shelf 53, and a lower reverse flange 55.

Reverse flange 55 is incorporated in this embodiment as the sheet metal joist tends to tip over relatively easily, and flange 55 distributes the centre of gravity more evenly about the vertical web axis so assisting balancing of the joist. The lower chord consists of a hollow tubular member. Elongated apertures 57 are spaced at equal intervals along the web 43.

Spacer bars 59, which are of a similar form to spacer bars 25 shown in FIG. 1 are used to correctly position the joists during construction, and to prevent them from tipping over. A further support bar 61 is shown, this being of angle cross-section along most of its length and having a cut-out portion 63 at each end, and tabs 65 providing an outer edge to the cut-out portions.

During construction, the joists are placed in position with the spacer bars in place to prevent them from tipping, and the bars 61 movably positioned across adjacent spacer bars. Sheets of plywood (not shown) are then placed between the joists upon the plywood supporting shelves, and are sized to fit against the inclined steps so that they force adjacent joists apart and securely hold the joists and the spacer bars together. Bars 61 support the central portion of the plywood, and can be aligned with any joints in the plywood to provide extra support and sealing along joints. Mesh reinforcement (not shown) is then placed over the joists and concrete is poured on to the plywood to a depth to completely cover the top chords of the joists and the mesh reinforcement to form a floor. When the concrete is hardened to a sufficient amount to be self-supporting, the spacer bars are twisted through 90 degrees with the aid of the handles 37, and are slid transverse to the joists to remove them from the elongated apertures. The bars 61, and the plywood above them can be removed so leaving a rough composite steel and concrete floor.

In both embodiments, the S-shaped upper section 9,49 of each upper chord is generally of zig-zag cross section with integral top, oblique and lower portions, while the lower section of each upper chord includes a concrete pouring form panel support shelf 13,53 which is integrally connected to the lower portion of the upper section 9,49 by a vertically disposed offsetting step down means such as an inclined step 11,51. The offset is of such vertical dimension that plywood sheets or concrete pouring form panels on opposite sides of the step 11,51 are held at the same level when the spacer bars are in place.

The embodiments of the invention in which an exclusive property or privilege is claimed are defined as follows:

1. A steel joist for use in a composite concrete and steel floor constructed by using concrete pouring form panels, said joist having upper and lower chords vertically spaced by a joining web, characterized by said upper chord comprising:

a single elongated member having an upper section with substantially a zig-zag cross section including integral top, oblique and lower portions the latter of which has an underside that extends transversely substantially flat from the lower end of said oblique portion for a substantial horizontal distance to an outer end, said elongated member further having, integral with said upper section, a lower section including a concrete pouring form panel support shelf extending horizontally in both the longitudinal and transverse directions of said elongated member, and said lower section of said elongated member further including vertically offsetting step down means integrally connecting said lower portion at its said outer end to said shelf for limiting the horizontal extent a first pouring panel can be pushed under said lower portion on one side of said step down means and providing the said shelf on the other side thereof at a given vertical level for supporting a pouring panel like said first panel at substantially the same level as said first panel.

2. A steel joist as in claim 1 wherein said shelf returns inwardly underneath itself from its outer longitudinal edge for a predetermined distance.

3. A steel joist as in claim 1 wherein said lower section of said elongated member further includes a vertically disposed flange secured to said web and integrally joined with the other longitudinal end of said shelf.

4. A steel joist as in claim 1 wherein said web is a flat steel sheet integrally joined with said lower chord and integrally joined to said shelf of said upper chord.

5. A steel joist as in claim 4 wherein said shelf returns inwardly underneath itself for at least a part of its transverse length and there joins integrally with said web, the shelf and its inward return being of such transverse lengths relative to the said upper section of said elongated member and the remainder of the lower section thereof and to said web and lower chord to cause the centre of gravity of said joist to be in the region of its central axis.

6. In combination, a plurality of steel joists for use in a composite concrete and steel floor constructed by using concrete pouring form panels, wherein each joist has an upper chord, a lower chord, and means joining and vertically separating the upper and lower chords, each said upper chord comprising:

a single elongated member having an upper section with substantially a zig-zag cross section including integral top, oblique and lower portions the latter of which has an underside that extends transversely substantially flat from the lower end of said oblique portion for a substantial horizontal distance to an outer end, said elongated member further having, integral with said upper section, a lower section including a shelf extending horizontally in both the longitudinal and transverse directions of said elongated member, said lower section of said elongated member further including vertically disposed offsetting step down means integrally connecting said lower portion at its said outer end to said shelf, said joists being similarly oriented as to the zig-zag cross sections of their upper sections and having a plurality of openings spaced longitudinally just below said lower part of each elongated member, a plurality of spacer bars each with notch means at each end for hooking on steel forming one of said apertures for spacing said joists a predetermined distance apart, and concrete pouring form panels disposed on said spacer bars with one edge of each panel being disposed under and held down on said spacer bars by said lower portion of said upper section of the elongated member of one chord with the opposite edge of a panel resting on said shelf of an adjacent joist, the vertically disposed offsetting step down means having a vertical dimension such that said shelf of each upper chord and lower portion of the upper part allow said panels on opposite sides of said step down means to be at substantially the same level.

7. The combination as in claim 6 wherein each said shelf returns inwardly underneath itself from its outer longitudinal edge for a predetermined distance at which it joins with said joining means.

8. A combination as in claim 6 wherein each said upper and lower chord joining means includes a zig-zag web and wherein the lower section of each said elongated member of each upper chord further includes a vertically disposed flange secured to the upper part of the respective web and joined integrally with the outer longitudinal end of the respective shelf.

9. The combination as in claim 6 wherein each of said upper and lower chord joining means is a flat steel sheet integrally joined with the respective lower chord and integrally joined to the shelf of the respective upper chord.

10. The combination as in claim 9 wherein each said shelf returns inwardly underneath itself for at least a part of its transverse length and there joins integrally with the respective web, the shelf and its inward return being of such transverse lengths relative to the upper section of the respective elongated member and the remainder of the lower section thereof and to the respective web and lower chord to cause the centre of gravity of each said joist to be in the region of its own central axis.

* * * * *